United States Patent [19]

Herzig

[11] 4,177,712

[45] Dec. 11, 1979

[54] AIR DRIVEN TOOL WITH DOUBLE-ENDED ALIGNED PISTONS OPPOSITELY DRIVEN

[76] Inventor: Albert M. Herzig, 700 N. Rexford Dr., Beverly Hills, Calif. 90210

[21] Appl. No.: 885,177

[22] Filed: Mar. 10, 1978

[51] Int. Cl.[2] ..... F01L 33/04; F01B 9/00; F01B 7/02; F01B 7/16

[52] U.S. Cl. ..... 91/179; 92/136; 92/151; 91/6

[58] Field of Search ..... 91/179, 186, 328, 411 R; 92/136, 151, 152; 51/150 TL

[56] References Cited

U.S. PATENT DOCUMENTS

| | | | |
|---|---|---|---|
| 955,896 | 4/1910 | Morrison | 91/179 |
| 1,954,489 | 4/1934 | Portlow | 51/170 TL |
| 2,737,157 | 3/1956 | Hefner et al. | 92/151 |
| 3,214,823 | 11/1965 | Hendrickson | 91/328 |
| 3,274,895 | 9/1966 | Hendrickson | 91/179 |

FOREIGN PATENT DOCUMENTS

| | | | |
|---|---|---|---|
| 1417918 | 12/1975 | United Kingdom | 51/170 TL |

*Primary Examiner*—Paul E. Maslousky
*Attorney, Agent, or Firm*—Herzig & Walsh, Inc.

[57] ABSTRACT

A single tool carrier reciprocatingly driven in opposite directions by a pair of double ended reciprocating pneumatic pistons, one of the pistons driving the carrier through rack and pinion gear means and the other piston driving the carrier through a pin integrally connected to the carrier, mounted vertically on the carrier and engaging the said other piston. Seal rings, preferably of Teflon, are mounted on both ends of both pistons. The pistons operate in opposite directions. One piston is made relatively light so that its weight and the weight of the other shoe are counterbalanced against each other.

12 Claims, 14 Drawing Figures

AIR DRIVEN TOOL WITH DOUBLE-ENDED ALIGNED PISTONS OPPOSITELY DRIVEN

BACKGROUND OF THE INVENTION

1. Field of the Invention

The field of the invention is that of reciprocating pneumatic power tools of the type adapted for sanding, rubbing, burnishing, etc.

2. Description of the Prior Art

The background in this type of tool is illustrated in the following U.S. Pat. Nos.:

| | |
|---|---|
| 987,940 | 2,635,396 |
| 1,492,659 | 2,648,121 |
| 1,493,650 | 2,666,978 |
| 1,590,353 | 2,722,917 |
| 1,677,112 | 2,813,514 |
| 1,953,534 | 2,835,957 |
| 1,954,489 | 2,722,917 |
| 2,080,451 | 2,813,514 |
| 2,120,300 | 2,835,957 |
| 2,202,072 | 3,108,409 |
| 2,224,132 | 3,274,895 |
| 2,225,395 | 3,399,494 |
| 2,521,566 | 3,214,823 |
| 2,598,480 | 3,563,134 |
| 2,620,775 | |

Tools of the type of this application are known wherein a single shoe is driven by a pair of aligned or "in line" reciprocating pistons. An illustration of this type of tool is in U.S. Pat. No. 3,214,823. In the prior art tool the single shoe is driven by the pistons by way of rack and pinion gears, the pistons both moving in the same direction.

The areas or aspects of the prior art tools in which there has been room for improvement are that of the power of the tool for producing the reciprocating movement and in the amount of undesired vibration that is imparted to the tool by the reciprocating pistons. The manner in which these needs for improvement have been fulfilled are covered in the detailed description of the herein invention appearing hereafter.

SUMMARY OF THE INVENTION

The preferred embodiment of the invention is an air operated machine adapted to the operations of sanding, rubbing or filing the work to which the tool carried by the carrier is applied manually.

The invention may be summarized as follows:

An air operated motor including a pair of tandemly mounted reciprocating pistons, each having sealing means on each end, a reciprocating carrier connected substantially directly with one of said pistons and connected to the other of said pistons by a rack and pinion connection, and valve controlled fluid pressure means for alternately pressurizing simultaneously the inner and then the outer ends of both pistons. The pistons are each driven by air pressure at both ends. They move in opposite directions. The piston that is directly connected to the shoe so as to move in the same direction as the shoe is made relatively lighter. Its weight with the weight of the shoe serve to counterbalance the weight of the other piston.

As stated, one of the pistons is connected to the carrier through the rack and pinion reversing means so that the piston and the carrier move in opposite directions, the other piston being directly connected to the shoe and moves in the same direction as the shoe and in a direction opposite to that of the one piston. That is, the pistons move in opposite directions. Each end of each piston is driven by penumatic pressure. Since both ends of the pistons are driven the power of the tool is essentially doubled over tools not similarly driven. This purpose is realized in an advantageous way since the same valve mechanism can be used as that which is utilized for a pair of pistons each of which is only driven from one end or for a single piston driven from both ends.

Inasmuch as the two pistons move in opposite directions, one piston being lighter than the other while reciprocating, this has a beneficial effect on the balancing of the tool and the inducement of vibration which can be detrimental to the user. Because the pistons move in opposite directions, the weight of the lighter piston and the shoe counterbalances as against the weight of the other piston.

In light of the foregoing the primary object of the invention is to make available improvements in tools of the type described, particularly, tools having plural in-line reciprocating pistons.

A particular object is to realize a tool having greater power, in fact substantially twice the power for the same relative size and weight of the tool.

A further object is to realize improved characteristics from the standpoint of operation by way of having a pair of inline pistons that move oppositely to each other so that their momentums and relative affect on the body of the tool are counterbalanced.

Vibration is minimized by balancing the weight of the piston that is attached directly to the carrier and the weight of the carrier against the weight of the other piston by using solid and hollow construction where necessary to do this.

Further olbjects and advantages will appear from the following detailed descriptions and annexed drawings in which.

DESCRIPTION OF THE PREFERRED EMBODIMENTS

Figure 3:
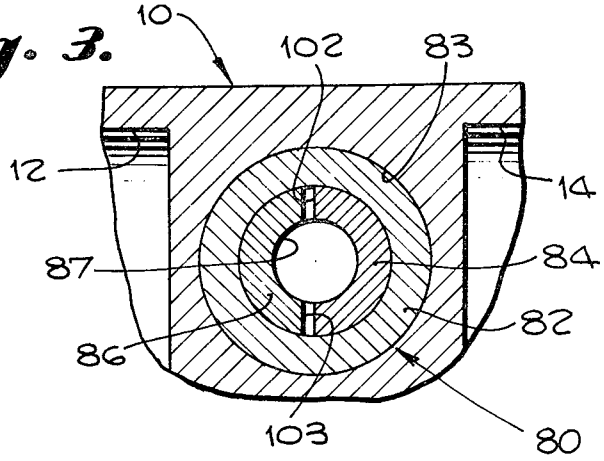
FIG. 3 is a sectional view of the valve taken along line 3—3 of FIG. 1 with the pistons at their outer positions.

Turning now to the details shown in FIGS. 1 to 10 of the drawings, the machine assembly includes a body 10, having cylinder bores 12, 14 in which are reciprocally mounted pistons 16, 18, having seals 19—19' and 21—21' on the ends of both of them, which reciprocally drive a shoe carrier 20 upon which is mounted a desired working tool, such as one for sanding, rubbing, filing, or the like, the work to which the machine is applied manually. The shoe may be one as known in the prior art. Within each cylinder bore a sleeve or liner may be provided.

The novel and inventive features of the present invention reside in features of construction made clear hereinafter.

The machine has rear handle 22 on the body 10 and it has a control lever 24 pivotally mounted on pivot pin 23 so that gravity keeps the lever 24 in operative contact with the top of valve plunger 26 ready to start and stop the hereinafter described drive means by pressing and releasing, respectively, the handle lever 24.

The front of the handle 22 is mounted on the body 10 to be gripped by the rearward hand of the operator (the right hand of the right-handed operator). A front handle or know 27, is connected to body 10 by threaded connector 32 and is gripped by the front hand of the operator when the machine is operatively engaging its work.

The body has outer ends or end caps 34, 36 which are secured to the ends of body 10 by connectors as shown at 38 closing the outer ends of cylinder bores 12, 14, to form working chambers in which to reciprocate pistons 16, 18, when they are actuated by manual depression of handle lever 24, as described hereinafter. Sealing gaskets 33 and 37 are provided at each end of body 10 to make a fluid-tight engagement between the end caps 34 and 36 and body 10.

The reciprocating movement and driving of the pistons 16, 18 is transmitted to the carrier 20 by novel means and mode of operation, the preferred form of which is shown in the Figures and will now be described.

The front piston 16 has spaced flanges 33—33' between which is received a pin or connector 40 which is integrally connected at its bottom end through connector bracket and rivets 42 with carrier 20 whereby the reciprocating movement and driving force of front piston 16 is transmitted through pin 40 to the carrier 20.

The rear piston 18 has a cutout 35 having a flat upper surface in which is mounted a gear rack 44 whose teeth face and extend downwardly in constant-mesh operating engagement with the teeth 48 of the pinion gear wheel 50, which rotates about the axis of its pinion shaft 52, which, in turn, is preferably fixedly mounted on body 10 with a roller bearing ring 54 mounted between pinion shaft 52 and pinion gear wheel 50. Rack 44 may be attached by rivets. Alternately, shaft 52 and gear wheel 50 can be integrally interconnected, and then shaft 52 can be suitably journalled in the body.

Pinion gear wheel 50 is also in constant-mesh operative engagement with the upwardly facing teeth 56 of carrier rack 58 which is integrally mounted longitudinally to the carrier 20 by rivets at a position where its said teeth 56 will constantly also mesh with the teeth 48 of gear wheel 50. In this way longitudinal reciprocation of piston 18 is transmitted in the reverse direction through gear rack gear 44, pinion gear wheel 50, and carrier gear rack 58 to the carrier 20 and whatever tool is mounted on it.

The novel drive connection including one direct pin drive and one pinion gear drive between the pistons and the carrier produces a new mode of operation and new result of a more powerful and faster driving carrier. This is enhanced by provision of a dual drive on both pistons through an overall fluid drive system shown in the Figures. That is, both pistons are double-ended, both ends being driven.

When handle lever 24 is depressed manually, it in turn depresses valve plunger 60 downwardly against the force of spring 62 in inflow valve 64, thereby moving ball valve 66 off of its seat and establishing a fluid flowing connection between pressure intake 68 (and its source) and inflow conduit 70 which connection remains constant as long as handle bar 24 is thus manually held depressed (thereby keeping seated valve 66 open).

Figures 4, 5, 6:
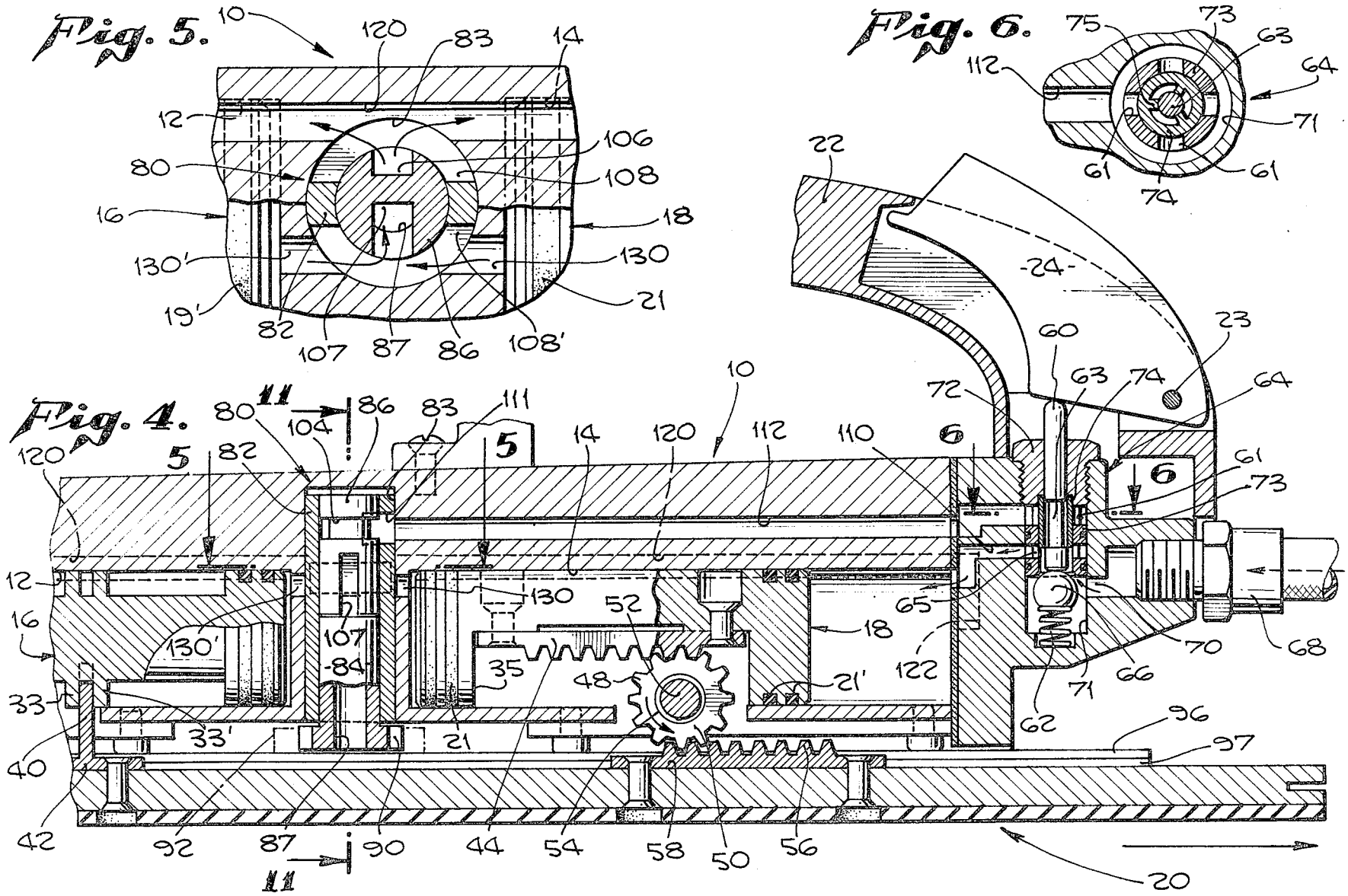
FIG. 4 is an enlarged partial longitudinal and sectional view of the machine showing the control valve in section.
FIG. 5 is a sectional view of the valve taken along line 5—5 of FIG. 4.
FIG. 6 is a sectional view of the air admission valve taken along the line 6—6 of FIG. 4.

FIG. 6 is a cross-sectional view taken along line 6—6 of FIG. 4. The valve 64 is in bore 71 in body 10. Stem 60 extends through threaded plug or fitting 72. Plug 72 has a cylinder part 73 sealed to bore 71 by O-rings as shown and having radial openings 61. Within cylinder or sleeve 73 is sleeve 74 which has radial vanes extending inwardly as shown at 75 forming flutes for passage of air. Plunger 60 has an intermediate part 63 of smaller diameter on which is carried sleeve 74. When valve 64 is first cracked open air is admitted from below sleeve 74 to a side port 65 in cylinder 73 to channel 110 communciating with cylinder bore 14. This air serves to start movement of piston 18. In the open position of valve 64, FIG. 7, sleeve 74 uncovers ports 61 in cylinder 73 admitting air to channel 112.

Air pressure is delivered from the valve 72 through channel 112 to a valve 80, which is positioned in between the pistons 16 and 18 and which controls the flow of air to the ends of the pistons. The valve is a rotary valve which is driven by a rack carried by the reciprocating shoe as will be described. The valve 80 is shown in vertical cross-section in FIG. 11, and in horizontal cross section in FIGS. 2, 5, and 8, and FIG. 14 is an isometric view of it.

Numeral 82 designates a valve sleeve which is in a bore 83 in the body 10. The valve comprises a lower part 84 and an upper part 86. The lower part 84 is tubular as shown, having a bore 87 and on the end of it is a gear 90 which is driven by a rack 92. At the sides of the body 10 at its lower part are bracket members 94 and 94' having inwardly turned flanges 95 and 95' in which members 96 and 96' can slide, these members being connected to the shoe through a member 97. The rack 92 is carried over the member 96'.

The upper end of the valve member 84 is of semi-circular configuration as shown at 102. The upper and lower valve parts 86 and 84 interengage at their semi-circular cut-out ends 102 and 103 as shown in FIG. 3 there being a slight gap in the juxtaposed surfaces. The purpose is to properly time the valve movements in relation to piston movements.

Figures 7, 8:
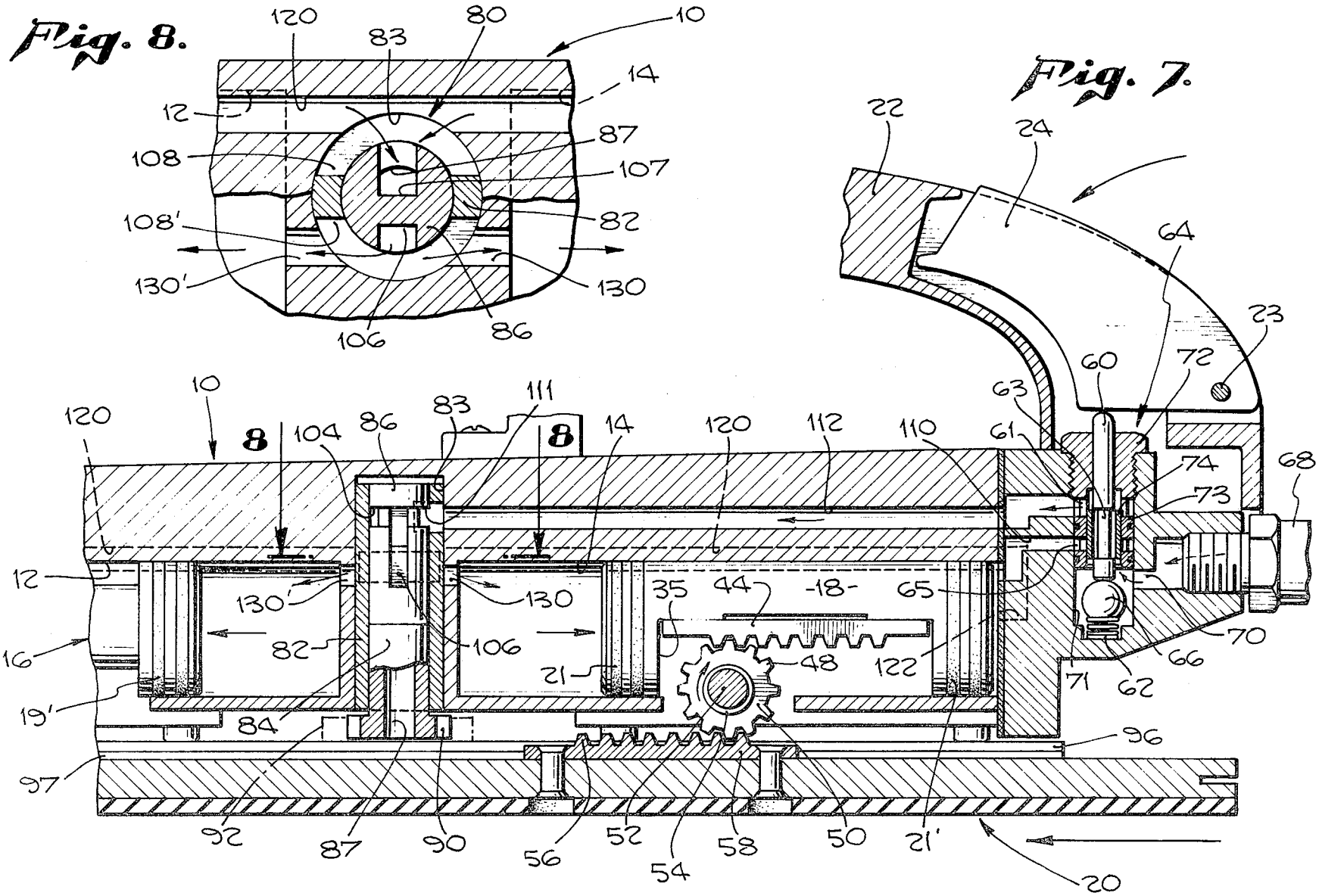
FIG. 7 is a sectional view similar to that of FIG. 4 showing the pistons moving outwardly.
FIG. 8 is a sectional view of the valve along the line 8—8 of FIG. 7.
Figure 14:
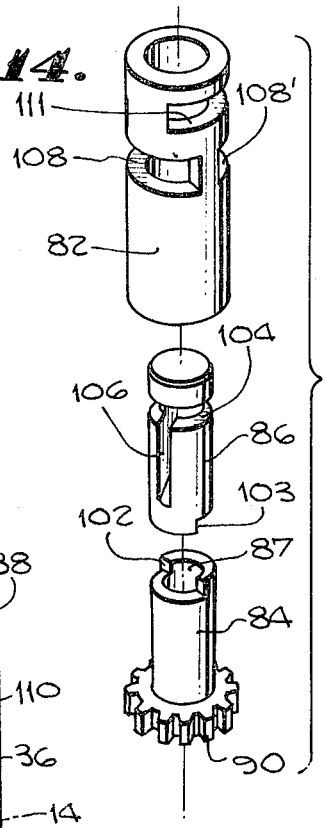
FIG. 14 is an exploded isometric view of the valve means.
Figure 10:
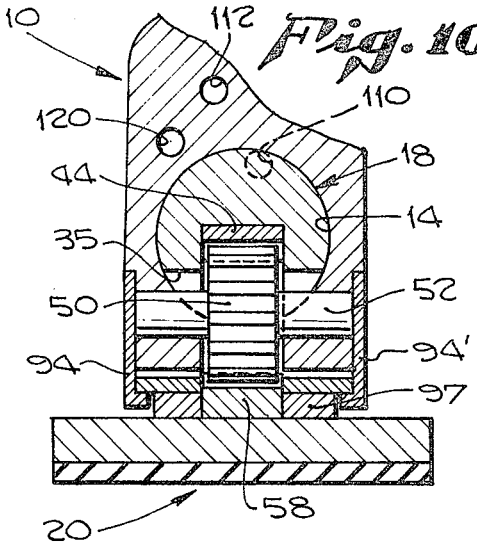
FIG. 10 is a sectional view taken along the line 10—10 of FIG. 1.
Figure 9:
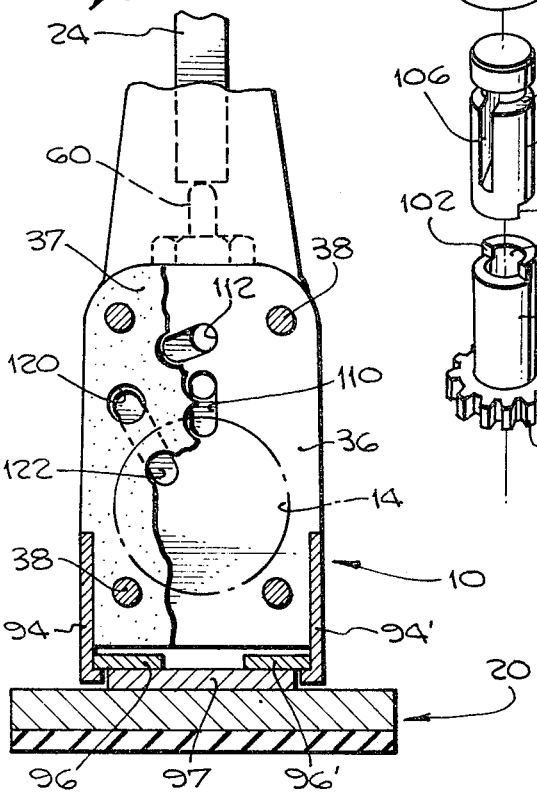
FIG. 9 is a sectional view taken along the line 9—9 of FIG. 1.
Figure 11:
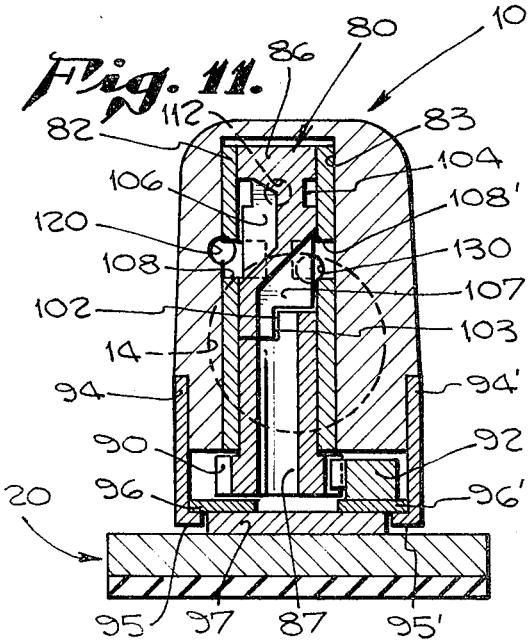
FIG. 11 is a sectional view taken along the line 11—11 of FIG. 4.

The upper section 86 of the valve has an annular cut-out in it as may be seen at 104 in FIGS. 4, 7, and 11. This annular cut-out extends all the way around valve part 86. The result is that the incoming air pressure exerts no axial force on the valve which is a distinct advantage. Part 86 of the valve has an axial cut out in one side as designated at 106 which communicates with annular cut-out 104. It has an axial cut out in the other side as designated at 107 and at the position of the cut-out 107 sleeve 83 has oppositely disposed angular cut-outs as designated at 108 and 108'. The axial cut-outs or ports serve to provide for inlet communciation to ends of cylinders and exhaust communciation from ends of cylinders as will be described. Sleeve has an upper arcuate cut-out 111.

Figure 1:
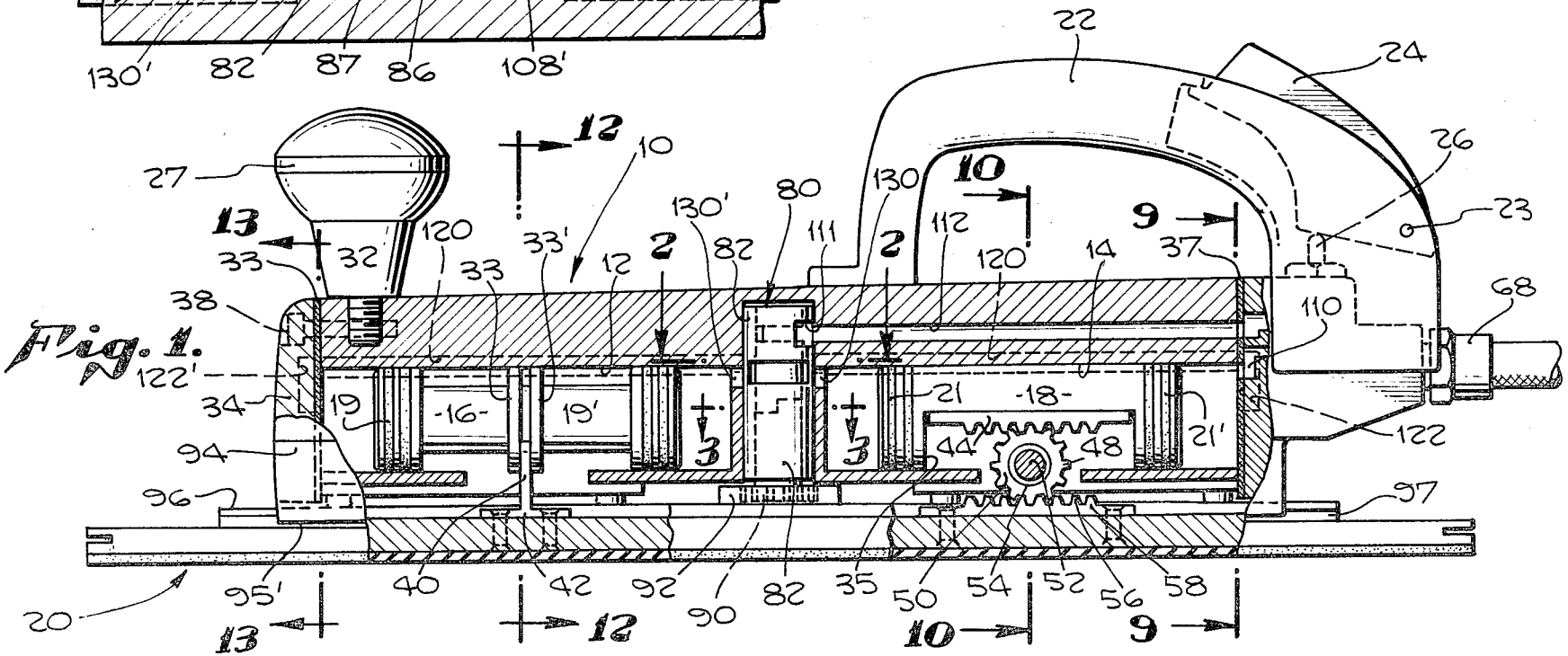
FIG. 1 is a longitudinal sectional view of the entire machine.

FIG. 1 shows the pistons in an intermediate position. FIG. 4 shows the pistons moved all the way inwardly in the body. FIG. 7 shows the two pistons moving outwardly.

Figure 12:
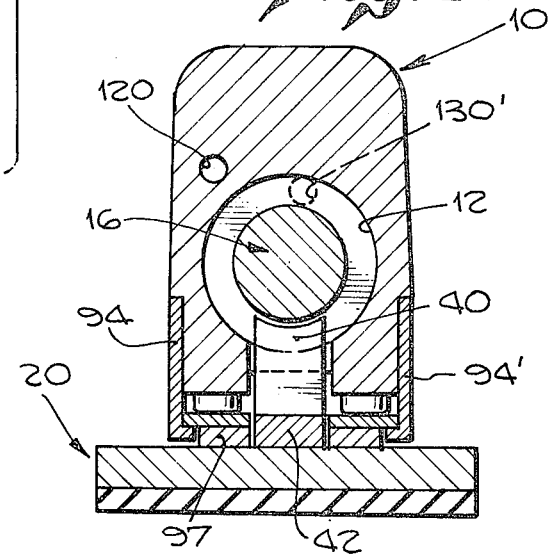
FIG. 12 is a sectional view taken along the line 12—12 of FIG. 1.

Numeral 110 designates a passgeway communicating with the bore 14 which admits air to this bore when valve 64 is first cracked. This air acts on piston 18 sufficiently to prevent the piston mechanism from locking in what may be called a dead center position. See FIGS. 9, 10, and 12. As valve 64 opens to a position as shown in FIG. 7, the sleeve 74 is moved downwardly as shown so that passageway 110 is closed off.

When valve 64 is open as shown in FIG. 7, air is admitted from above the sleeve 73 into the passage 112 which leads to side cut-out or port 111 in the valve sleeve 82. The position of the port or channel 112 may be seen in FIGS. 9 and 10. The channel 110 can also be seen in these figures.

The air coming in through channel 112 passes through the port 111 in the sleeve 82 and into the annular cut-out 104 in the valve part 86. It passes into the cut-out 106 which is in communication with the angular cut-out or port 108 in the sleeve 82. See FIG. 5. The air now passes into the longitudinal channel 120. As may be seen in the Figures the end of this channel communicates with channel 122 which is in the base or the end fitting 36 and which communicates with the bore 14. See FIG. 9. Also, see FIG. 10.

Figure 13:
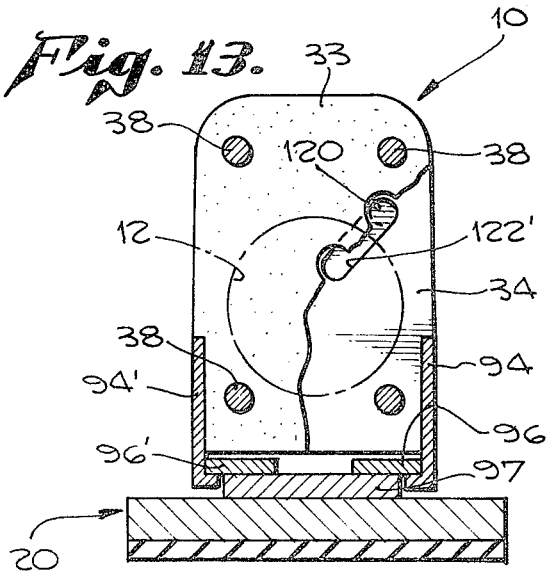
FIG. 13 is a sectional view taken along the line 13—13 of FIG. 1.

The channel 120 extends lengthwise of the body 10 and communicates with the end cap 34 which has a channel 122' formed in it which communicates with the bore 12 as may be seen in FIG. 1. Also see FIG. 13.

Provided in the member closing the inner end of bore 14 is a port 130 and formed in the member closing the end of bore 12 is a similar port 130' as may be seen in FIGS. 1, 4, 5, and 7.

FIG. 5 shows the valve 80 in a position wherein air pressure is being supplied to the outer ends of the pistons and air is being exhausted from the inner ends. The air passes through cut-out 111 to annular cut-out 104 to cut-out 106, to channel 120 and to the channels 122 and 122'. The air is exhausted through the ports 130 and 130 through the angular cut-out 108' in the sleeve 82, through the cut-out 107 in the part 86 of the valve and then downwardly and through the bore 87 in the lower part 84 of the valve to be exhausted at the bottom. In the position of the parts as shown in FIG. 4 the pistons are at the ends of their inward stroke, the valve has been driven to the position of FIG. 5 by the rack 92 engaging the gear 90.

Figure 2:
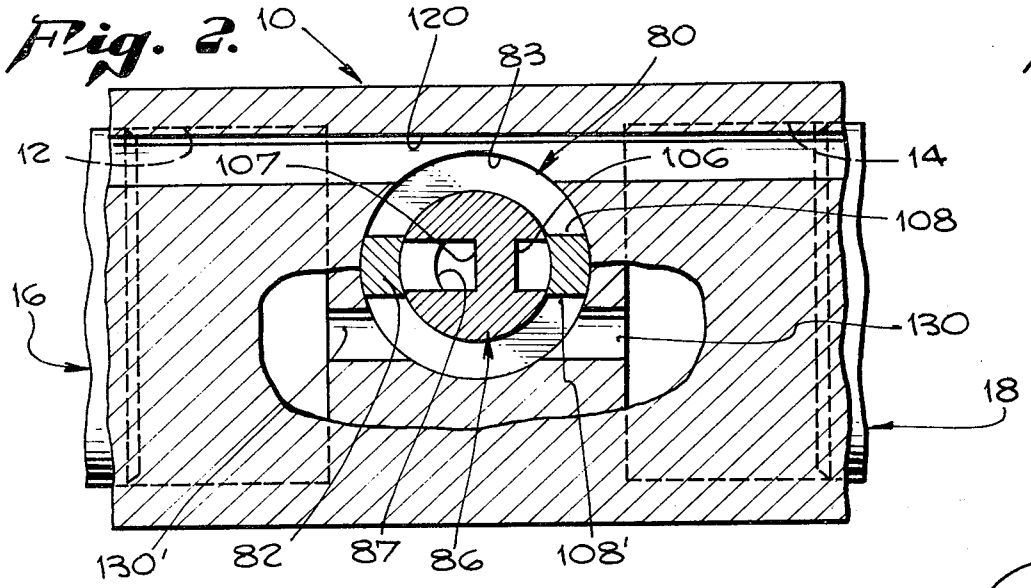
FIG. 2 is a sectional view taken along line 2—2 of FIG. 1 of the fluid valve with the pistons at their inner position (both pistons move inwardly and outwardly together).

FIG. 2 shows the valve 80 in its intermediate position wherein air is neither being admitted to the piston chambers or exhausted therefrom. Neither of the cut-outs 106 or 107 of the valve is in communication with the cut-outs 108 and 108' of the valve sleeve 82.

FIG. 8 shows the valve in its position which is opposite to that of FIG. 5 for driving the pistons in the opposite direction that is inwardly. As may be seen, the inlet cut-out 106 in the valve part 86 now communicates with cut-out 108 in the sleeve 82 so that air is admitted to the ports 130 and 130' at the inner ends of the pistons. The exhaust cut-out 107 is now in communication with the cut-out 108' in the sleeve 82 so that the exhaust communicates with the channel 120 to exhaust air from the outer ends of the pistons which is exhausted as previously described.

From the foregoing, those skilled in the art will readily understand the nature and contribution of the invention in the manner in which it achieves and realizes all of the objectives as set forth in the foregoing.

The foregoing disclosure is representative of the preferred form of the invention and is to be interpreted in an illustrative rather than a limiting sense, the invention to be accorded the full scope of the claims appended hereto.

What is claimed is:

1. A pneumatic motor including a pair of tandemly mounted reciprocating pistons and a reciprocating carrier connected substantially directly to one of the pistons for direct drive thereof in the same direction as said one piston, and connected by a reversing rack and pinion connection to the other of said pistons, whereby the pistons operate in opposite directions.

2. A tool carrier and a pneumatic motor comprising a body having a pair of tandemly mounted pistons, one substantially directly connected to the carrier for direct drive thereof in the same direction as said one piston, the other connected to the carrier by reversing rack and pinion means, valve controlled air pressure operating both pistons reciprocally, and control means for the valve operated by rack and pinion connection means operating between the carrier and the valve.

3. A fluid operated machine including a body, a plurality of pistons reciprocally mounted in longitudinal bores in the body, a tool carrier mounted for longitudinal reciprocal movement beneath the body, one of said pistons being substantially directly operatively connected to said tool carrier for direct drive thereof in the same direction as said one piston, another of said pistons being connected to said tool carrier by a rack and pinion reverse driving connection, and a fluid pressure intake and exhaust system operating said pistons and controlled by valve means operated by the tool carrier through a rack and pinion connection between the valve means and the tool carrier.

4. A fluid operated machine as claimed in claim 3 wherein the valve means is mounted between the directly connected piston and the rack and pinion connected piston.

5. A fluid operated machine as claimed in claim 3 said one piston being made relatively lighter, the weight of the rack and pinion actuated piston being balanced with respect to the combined weight of the one piston, the tool carrier, its tool and the connection between said one piston and the tool carrier to minimize vibration of the machine.

6. A fluid operated machine including a body, a pair of double ended pistons reciprocally tandem mounted in a pair of bores in the body, a tool carrier mounted for longitudinal reciprocal movement beneath the body, one of said pistons being substantially directly connected to said tool carrier, the other of said pistons having a longitudinally extending rack gear, with downwardly facing teeth, integrally mounted on the bottom of said other piston, said teeth being in constant meshing relation with the teeth of a pinion gear mounted on a pinion shaft that is mounted in the body horizontally to the longitudinal axis of said body, said pinion gear teeth also being in constant meshing engagement with a carrier rack gear mounted longitudinally on the carrier, with its teeth facing the teeth of the said piston rack gear whereby movement of the last mentioned piston moves the carrier in the direction opposite to that of the rack gear equipped reciprocating piston above the carrier gear rack, sealing means on each end of each piston, and a fluid pressure intake and exhaust system operating said pistons and controlled by valve means operated by the tool carrier through a rack and pinion connection between the valve means and the tool carrier.

7. A manually held fluid actuated tool including a body, a pair of reciprocating pistons tandemly mounted in a pair of tandem bores in the body; valve means mounted in the body between the pistons controlling the fluid so as to alternatively air drive the inner and outer ends of the pistons and simultaneously exhaust to the ambient atmosphere the air at the piston ends opposite the driven piston ends, a tool carrier, substantially direct drive means connecting the tool carrier to one of the said pistons for direct drive thereof in the same direction as said one piston, and reversing rack and pinion drive means connecting the tool carrier to the other of said pistons, each of the said pistons having sealing means on each end thereof.

8. A tool as claimed in claim 6 in which the weight of the carrier and the direct drive piston assembly is balanced against the weight of the other piston to minimize the vibration of the tool.

9. A device as in claim 1 including a source of fluid pressure and valve means for alternately supplying an exhausting fluid pressure to opposite ends of the pistons for driving them.

10. A device as in claim 9 including channel means communicating with the said valve means for delivering fluid pressure alternately to respective first ends of the pistons and to respective second ends of the pistons and for exhausting fluid alternately from first respective ends of the pistons and from second respective ends of the pistons.

11. A device as in claim 10 wherein the said valve means includes a valve body and valve member, the said valve body and valve member having ports having communication with the channel means whereby in one position of the valve member fluid is delivered to the respective first ends of the pistons while being exhausted from the respective second ends of the pistons, and in a second position of the valve member fluid is delivered to the respective second ends of the pistons and exhausted from the respective first ends of the pistons whereby both ends of each piston are driven with the pistons moving in opposite directions.

12. A pneumatic motor including a pair of tandemly mounted reciprocating pistons and a reciprocating carrier connected directly to one of the pistons for direct drive thereof in the same direction as said one piston, means including a rack and pinion connection between the other piston and the carrier, a source of fluid pressure and valve means for alternately supplying and exhausting fluid pressure to opposite ends of the pistons for driving them, channel means communicating with the said valve means for delivering fluid pressure, alternately to respective first ends of the pistons and then to respective second ends of the pistons and for exhausting fluid alternately from respective first ends of the pistons and from respective second ends of the pistons.

* * * * *